US008599089B2

(12) United States Patent
Bevelacqua et al.

(10) Patent No.: US 8,599,089 B2
(45) Date of Patent: Dec. 3, 2013

(54) CAVITY-BACKED SLOT ANTENNA WITH NEAR-FIELD-COUPLED PARASITIC SLOT

(75) Inventors: Peter Bevelacqua, Cupertino, CA (US); Robert J. Hill, Salinas, CA (US)

(73) Assignee: Apple Inc., Cupertino, CA (US)

( * ) Notice: Subject to any disclaimer, the term of this patent is extended or adjusted under 35 U.S.C. 154(b) by 569 days.

(21) Appl. No.: 12/750,661

(22) Filed: Mar. 30, 2010

(65) Prior Publication Data

US 2011/0241948 A1 Oct. 6, 2011

(51) Int. Cl.
*H01Q 13/10* (2006.01)

(52) U.S. Cl.
USPC ..... 343/770; 343/767; 343/775

(58) Field of Classification Search
USPC ..... 343/767, 770, 769, 775
See application file for complete search history.

(56) References Cited

U.S. PATENT DOCUMENTS

| | | | | |
|---|---|---|---|---|
| 2,812,514 | A | 11/1957 | Smith | |
| 2,834,959 | A | 5/1958 | Dome | |
| 3,312,976 | A | 4/1967 | Gregory | |
| 4,208,660 | A | 6/1980 | McOwen | |
| 4,245,222 | A | 1/1981 | Eng et al. | |
| 4,710,775 | A | 12/1987 | Coe | |
| 4,733,245 | A * | 3/1988 | Mussler | 343/769 |
| 5,648,786 | A | 7/1997 | Chung et al. | |
| 5,917,454 | A * | 6/1999 | Hill et al. | 343/769 |
| 6,002,311 | A | 12/1999 | Wey et al. | |
| 6,081,729 | A | 6/2000 | Bauerschmidt et al. | |
| 6,198,453 | B1 * | 3/2001 | Chew | 343/771 |
| 6,225,959 | B1 | 5/2001 | Gordon | |
| 6,339,400 | B1 | 1/2002 | Flint et al. | |
| 6,373,351 | B1 | 4/2002 | Kubota et al. | |
| 6,380,930 | B1 | 4/2002 | Van Ruymbeke | |
| 6,686,886 | B2 | 2/2004 | Flint et al. | |
| 6,853,336 | B2 | 2/2005 | Asano et al. | |
| 6,894,650 | B2 | 5/2005 | Darden et al. | |

(Continued)

FOREIGN PATENT DOCUMENTS

| | | |
|---|---|---|
| GB | 2074792 | 11/1981 |
| JP | 61284102 | 12/1986 |
| WO | 2010013982 | 2/2010 |

OTHER PUBLICATIONS

Chiang et al., U.S. Appl. No. 12/500,570, filed Jul. 9, 2009.

(Continued)

*Primary Examiner* — Hoang V Nguyen
*Assistant Examiner* — Kyana R McCain
(74) *Attorney, Agent, or Firm* — Treyz Law Group; G. Victor Treyz; David C. Kellogg

(57) ABSTRACT

Electronic devices may be provided with antennas. The antennas may include conductive antenna cavities. Antenna resonating elements may be mounted in the antenna cavities to form cavity antennas. An antenna cavity may be formed from metal structures with curved edges that define a curved cavity opening. A flexible printed circuit substrate may be coated with a layer of metal. Slot antenna structures such as a directly fed antenna slot and a parasitic antenna slot may be formed from openings in the metal layer. The flexible printed circuit substrate may be flexed so that the antenna resonating element forms a non-planar curved shape that mates with the opening of the antenna cavity. A ring of solder may be used to electrically seal the edges of the cavity opening to the metal layer in the antenna resonating element. The curved opening may be aligned with curved housing walls in an electronic device.

18 Claims, 7 Drawing Sheets

(56) References Cited

U.S. PATENT DOCUMENTS

| | | | | |
|---|---|---|---|---|
| 6,919,853 | B2 * | 7/2005 | Jordan et al. | 343/770 |
| 6,950,069 | B2 | 9/2005 | Gaucher et al. | |
| 2003/0231086 | A1 | 12/2003 | Ishikawa et al. | |
| 2009/0128263 | A1 * | 5/2009 | Hesselbarth | 333/230 |
| 2009/0153407 | A1 | 6/2009 | Zhang et al. | |
| 2009/0153412 | A1 | 6/2009 | Chiang et al. | |

OTHER PUBLICATIONS

Chiang, U.S. Appl. No. 12/356,496, filed Jan. 20, 2009.
Kotani et al: "A rectangular cavity 1 backed slot antenna with parasitic slots", IEEE Antennas and Propagation Society International Symposium. 2001 Digest. Aps. Boston, MA, Jul. 8-13, 2001; vol. 3, pp. 166-169.
Vazquez et al., U.S. Appl. No. 12/238,384, filed Sep. 25, 2008.
Chiang et al., U.S. Appl. No. 12/401,599, filed Mar. 10, 2009.
Vazquez et al., U.S. Appl. No. 12/486,496, filed Jun. 17, 2009.
Chiang et al., U.S. Appl. No. 12/104,359, filed Mar. 16, 2008.
Guterman et al., U.S. Appl. No. 12/553,943, filed Sep. 3, 2009.
Vazquez et al., U.S. Appl. No. 12/553,944, filed Sep. 3, 2009.
Arnold, Shawn, "Flexible FR-4: A Low-Cost Replacement for Polyimide-based Circuits", Jun. 1, 2004, [online], retrieved Feb. 8, 2010, <http://www.circuitree.com/Articles/Feature_Article/305aa202930f7010VgnVCM100000f932a8c0_>.
Shiu et al., U.S. Appl. No. 12/750,660, filed Mar. 30, 2010.

* cited by examiner

CAVITY-BACKED SLOT ANTENNA WITH NEAR-FIELD-COUPLED PARASITIC SLOT

BACKGROUND

This relates generally to antennas, and more particularly, to electronic devices with cavity antennas such as cavity-backed slot antennas.

Electronic devices often incorporate wireless communications circuitry. For example, computers may communicate using the Wi-Fi® (IEEE 802.11) bands at 2.4 GHz and 5.0 GHz. Communications are also possible in cellular telephone telecommunications bands and other wireless bands.

To satisfy consumer demand for compact and aesthetically pleasing wireless devices, manufacturers are continually striving to produce antennas with appropriate shapes and small sizes. At the same time, manufacturers are attempting to ensure that antennas operate efficiently and do not interfere with nearby circuitry. These concerns are sometimes at odds with one another. If care is not taken, a small antenna or an antenna with a shape that allows the antenna to fit within a confined device housing may tend to exhibit poor efficiency or generate radio-frequency interference.

It would therefore be desirable to be able to provide electronic devices with improved antennas.

SUMMARY

Electronic devices may be provided with antennas. The electronic devices may be computers or other electronic equipment. A housing with curved housing walls may be used to house antennas and other electrical components for an electronic device.

The antennas may include conductive antenna cavities. The conductive antenna cavities may be formed from metal. Laser welding techniques may be used to join metal cavity parts to form an antenna cavity.

Antenna resonating elements may be mounted in antenna cavities to form cavity antennas. An antenna cavity may have metal structures with curved edges that define a curved cavity opening. An antenna resonating element may have a flexible printed circuit substrate that is coated with a layer of metal. Slot antenna structures such as a directly fed antenna slot and a parasitic antenna slot may be formed from openings in the metal layer.

The flexible printed circuit substrate in an antenna resonating element may be flexed about a flex axis so that the antenna resonating element bends and forms the shape of a non-planar curved layer that that mates with the curved opening of the antenna cavity. By using a flexible substrate that is sufficiently rigid to support the traces of the antenna resonating element, the need for underlying dielectric support structures can be reduced or eliminated.

A ring of solder may be used to electrically seal the edges of the cavity opening to the metal layer in the antenna resonating element. The curved opening may be aligned with curved housing walls in an electronic device.

Further features of the invention, its nature and various advantages will be more apparent from the accompanying drawings and the following detailed description of the preferred embodiments.

DETAILED DESCRIPTION

Antennas are used in wireless electronic devices to support wireless communications. The wireless electronic devices may be desktop computers, computer monitors, computer monitors containing embedded computers, wireless computer cards, wireless adapters, televisions, set-top boxes, gaming consoles, routers, or other electronic equipment. If desired, portable electronic devices such as laptop computers, tablet computers, or small portable computers of the type that are sometimes referred to as handheld computers may be provided with antennas. Antennas may be used in wireless electronic devices such as cellular telephones or media players. The wireless electronic devices in which the antennas are used may also be somewhat smaller devices. Examples of smaller wireless electronic devices include wrist-watch devices, pendant devices, handheld devices, headphone and earpiece devices, and other wearable and miniature devices.

Figure 1:
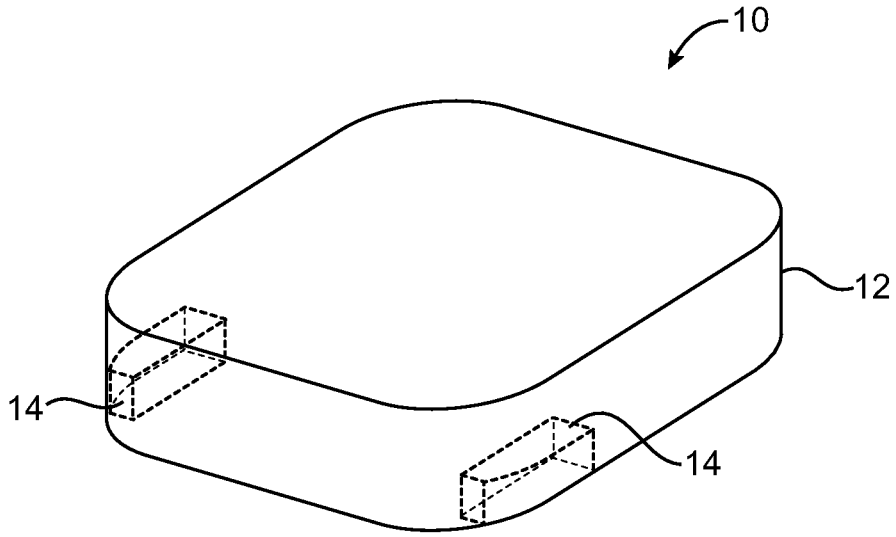
FIG. 1 is a perspective view of an illustrative electronic device with antennas in accordance with an embodiment of the present invention.

An illustrative electronic device that includes antennas is shown in FIG. 1. Electronic device 10 of FIG. 1 may have a housing such as housing 12. Housing 12 may include plastic walls, metal housing structures, structures formed from carbon-fiber materials or other composites, glass, ceramics, or other suitable materials. Housing 12 may be formed using a single piece of material (e.g., using a unibody configuration) or may be formed from a frame, housing walls, and other individual parts that are assembled to form a completed housing structure.

Antennas such as antennas 14 may be mounted within housing 12 (as an example). In general, there may be one antenna, two antennas, or three or more antennas in housing 12. In the example of FIG. 1, there are two antennas in device 10 formed flush with curved walls in housing 12. This is merely illustrative.

Antennas 14 may include an antenna resonating element and, if desired, a cavity structure. In a cavity-type antenna, a resonating element structure is placed adjacent to an opening in a conductive antenna cavity. The presence of the cavity can help prevent radio-frequency interference between the antenna and surrounding electrical components in device 10 and can help direct radio-frequency antenna signals in desired directions. A cavity structure may be used in connection with a patch antenna, a strip antenna, antenna resonating element traces with multiple arms, bends, and other features, or other suitable antenna resonating element structures. With one suitable configuration, which is sometimes described herein as an example, cavity-backed slot antennas are formed in which a slot antenna resonating element is backed by an antenna cavity. This is merely illustrative. In general, any suitable cavity antenna structures may be used in device 10 if desired.

Figure 2:
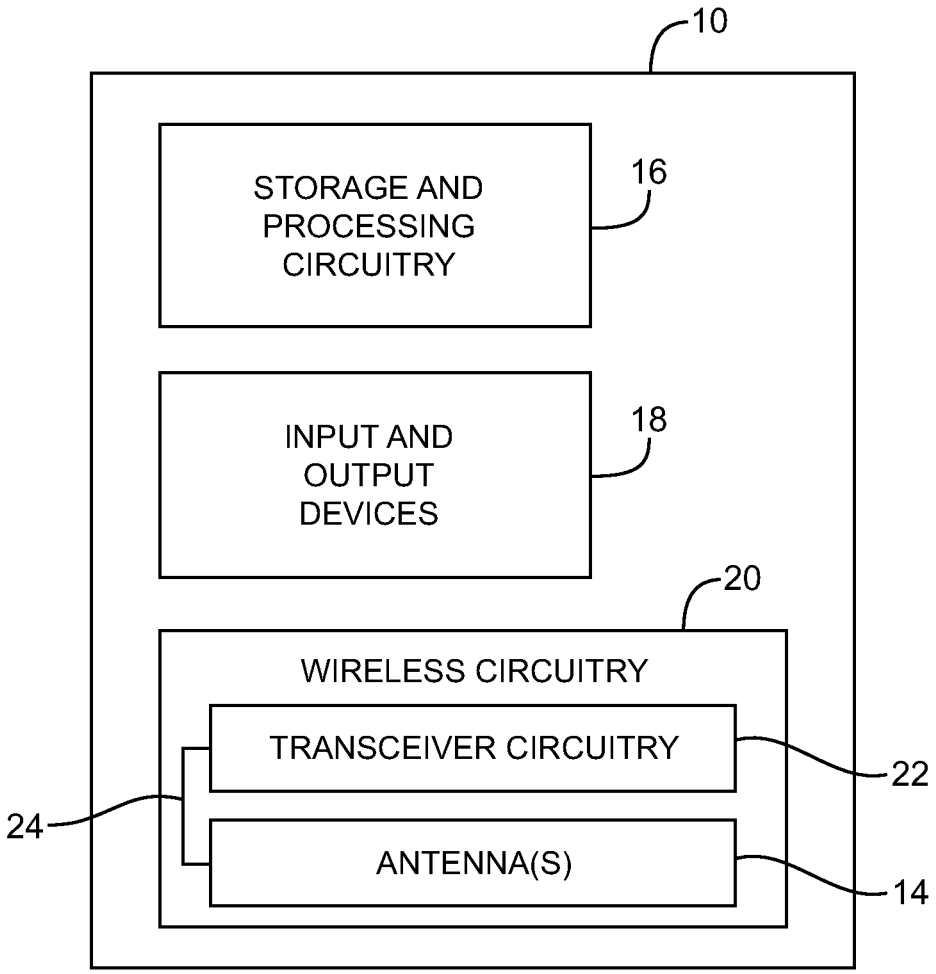
FIG. 2 is a circuit diagram of an illustrative electronic device with antennas in accordance with an embodiment of the present invention.

As shown in FIG. 2, device 10 may include storage and processing circuitry 16. Storage and processing circuitry 16 may include one or more different types of storage such as hard disk drive storage, nonvolatile memory (e.g., flash memory or other electrically-programmable-read-only memory), volatile memory (e.g., static or dynamic random-access-memory), etc. Storage and processing circuitry 16 may be used in controlling the operation of device 10. Processing circuitry in circuitry 16 may be based on processors such as microprocessors, microcontrollers, digital signal processors, dedicated processing circuits, power management circuits, audio and video chips, and other suitable integrated circuits.

With one suitable arrangement, storage and processing circuitry 16 may be used to run software on device 10, such as internet browsing applications, voice-over-internet-protocol (VOIP) telephone call applications, email applications, media playback applications, operating system functions, antenna and wireless circuit control functions, etc. Storage and processing circuitry 16 may be used in implementing suitable communications protocols. Communications protocols that may be implemented using storage and processing circuitry 16 include internet protocols, wireless local area network protocols (e.g., IEEE 802.11 protocols—sometimes referred to as Wi-Fi®), protocols for other short-range wireless communications links such as the Bluetooth® protocol, protocols for handling cellular telephone communications services, etc.

Input-output devices 18 may be used to allow data to be supplied to device 10 and to allow data to be provided from device 10 to external devices. Examples of input-output devices 18 that may be used in device 10 include display screens such as touch screens (e.g., liquid crystal displays or organic light-emitting diode displays), buttons, joysticks, click wheels, scrolling wheels, touch pads, key pads, keyboards, microphones, speakers and other devices for creating sound, cameras, sensors, etc. A user can control the operation of device 10 by supplying commands through devices 18 or by supplying commands to device 10 through an accessory that communicates with device 10 through a wireless or wired communications link. Devices 18 or accessories that are in communication with device 10 through a wired or wireless connection may be used to convey visual or sonic information to the user of device 10. Device 10 may include connectors for forming data ports (e.g., for attaching external equipment such as computers, accessories, etc.).

Wireless communications devices 20 may include communications circuitry such as radio-frequency (RF) transceiver circuitry 22. Circuitry 22 may include one or more integrated circuits such as baseband processors, radio-frequency transceivers, power amplifiers, matching circuits, filters, and switching circuitry. One or more transmission lines such as transmission lines 24 may be used to route radio-frequency antenna signals between antennas 14 and transceiver circuitry 22. Transmission lines 24 may include microstrip transmission lines, coaxial cable transmission lines, etc.

Figure 3:
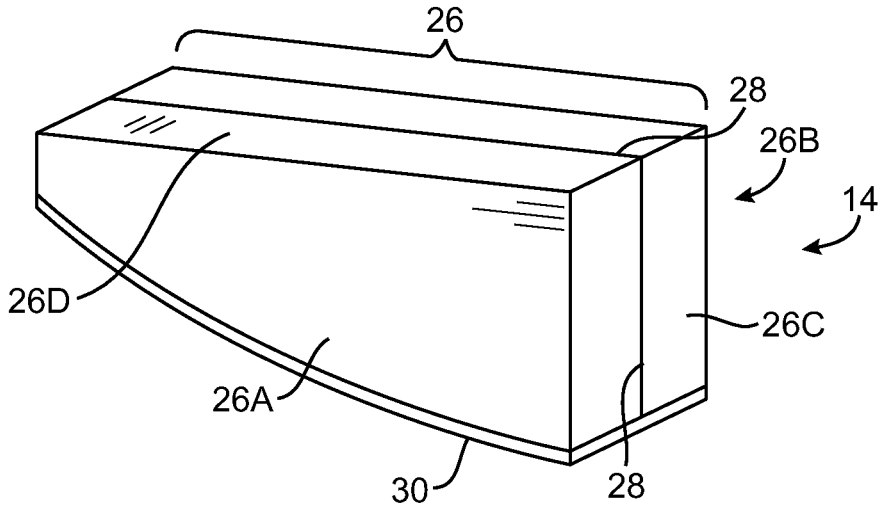
FIG. 3 is a bottom perspective view of an illustrative antenna in accordance with an embodiment of the present invention.

As shown in FIG. 1, device 10 may have a housing with curved sidewalls. To accommodate curved sidewalls or to satisfy other design constraints, it may be desirable to form a cavity-backed antenna with a curved antenna resonating element and a corresponding curved cavity opening. FIG. 3 shows an illustrative cavity antenna having a curved surface that may be used in a device such as device 10 of FIG. 1. FIG. 3 is a bottom perspective view of cavity antenna 14. As shown in FIG. 3, cavity antenna 14 may have a cavity structure such as cavity 26 and an antenna resonating element such as antenna resonating element 30. Cavity structure 26 may be formed from metal or other conductive materials, plastic or other dielectric support structures that have been coated with metal or other conductive materials, or other suitable conductive structures. If desired, cavity structure 26 may be formed from first and second pieces. For example, cavity structure 26 may be formed from first and second metal structures that are joined and laser welded at seam 28.

Antenna resonating element 30 may be formed on a substrate such as a printed circuit board that is mounted in an opening in cavity 26. In FIG. 3, cavity 26 is oriented so that its opening faces downward. As shown, cavity 26 may include planar vertical sidewall structures such as sidewalls 26A, 26B, and 26C and planar rear wall 26D. If desired, cavity 26 may be formed in other shapes (e.g., shapes with horizontally and vertically curved walls, shapes with bends, etc.). The example of FIG. 3 is merely illustrative.

Figure 4:
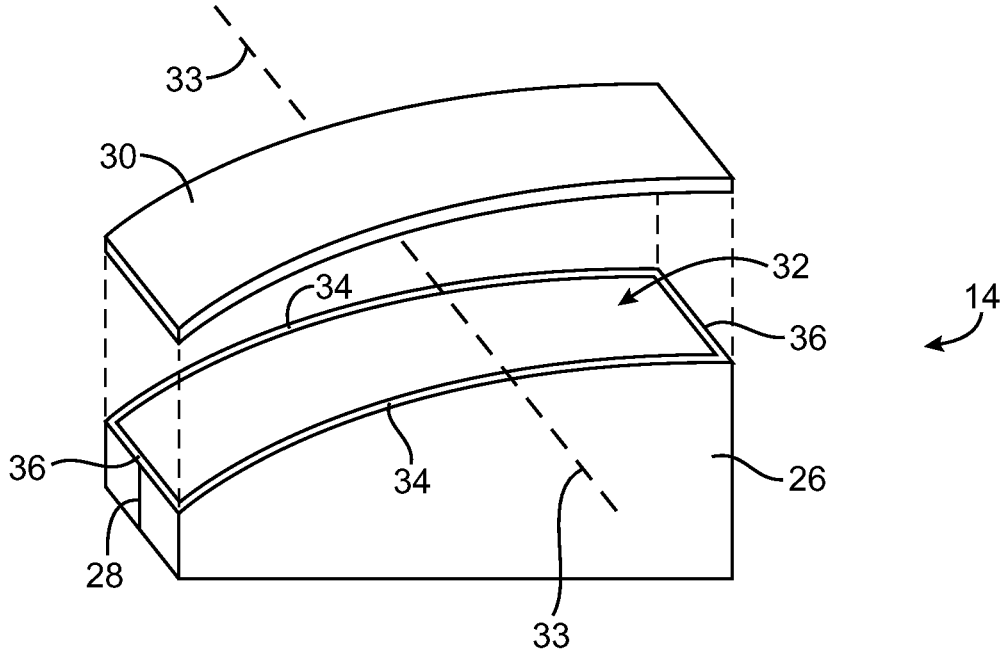
FIG. 4 is an exploded top perspective view of an illustrative antenna in accordance with an embodiment of the present invention.

FIG. 4 is an exploded perspective view of antenna 14 of FIG. 3 in an orientation in which cavity 26 is facing upwards. In this orientation, cavity opening 32 is visible at the top of cavity 26. Cavity opening 32 has four edges (in the FIG. 4 example), including curved edges 34 and straight edges 36. Because edges 34 are curved, opening 32 and other openings of this type are sometimes referred to as curved antenna cavity openings. Antenna resonating element 30 may have a curved shape such as a non-planar curved layer that is formed by flexing element 30 about flex axis 33. As a result, element 30 mates with the curved shape of opening 32. This provides antenna 14 with a curved shape that may fit against curved housing walls 12 of device 10, as shown in FIG. 1.

Antenna resonating element 30 may be formed from stamped metal foil, wires, traces of copper or other conductive materials that are formed on a dielectric substrate, combinations of these conductive structures, or other suitable conductive structures. The resonating elements may be based on patch antenna designs, inverted-F antenna designs, monopoles, dipoles, slots, antenna coils, planar inverted-F antennas, or other types of antenna. With one suitable arrangement, which is sometimes described herein as an example, antenna resonating element 30 is formed from a layer of metal or other conductive material (sometimes referred to as a ground plane element or ground plane) in which one or more slot antenna structures have been formed. The slot structures may, for example, be defined by rectangular or angled-rectangular openings in the conductive layer. The conductive layer may be formed from one or more copper layers (e.g., patterned copper traces) or other metals (as examples).

The conductive portions of antenna resonating element 30 may be formed on a dielectric substrate such as an injection-molded or compression-molded plastic part, on a rigid printed circuit board, or on a substrate formed from rigid and flexible portions ("rigid flex"). Antenna resonating element 30 may also be formed on a flexible printed circuit board that is based on a thin flexible layer of polymer such as a thin flexible sheet of polyimide. If desired, a support structure (e.g., a rigid support or a flexible layer of plastic) may be used to support the thin flexible polyimide sheet.

Antenna resonating element 30 may also be formed from rigid printed circuit board materials that have been formed in sufficiently thin layers to render them flexible. For example, antenna resonating element 30 may be formed from a layer of FR-4 (a flame retardant fiberglass-filled epoxy printed circuit board substrate material) that is about 0.09 to 0.2 mm thick, is about 0.05 to 0.3 mm thick, is less than 0.25 mm thick, is less than 0.2 mm thick, is about 0.14 mm thick, or is another suitable thickness that allows antenna resonating element 30 to be flexed to accommodate the shape of opening 32.

With this type of configuration, element 30 can be both sufficiently flexible to conform to curved opening 32 and sufficiently rigid to hold a desired shape without resting on an additional dielectric support structure (e.g., without using a plastic support in cavity 26). Because dielectric support structures can (if desired) be omitted from cavity 26, cavity 26 can be filled exclusively with air. As a result, there will be no dielectric support under antenna resonating element 30 in the interior of cavity 26. This may help reduce performance variations that might otherwise arise when placing element 30 adjacent to a dielectric support (e.g., performance variations that might arise from uncertainty in the small separation between the antenna element and the underlying dielectric support).

Figure 5:
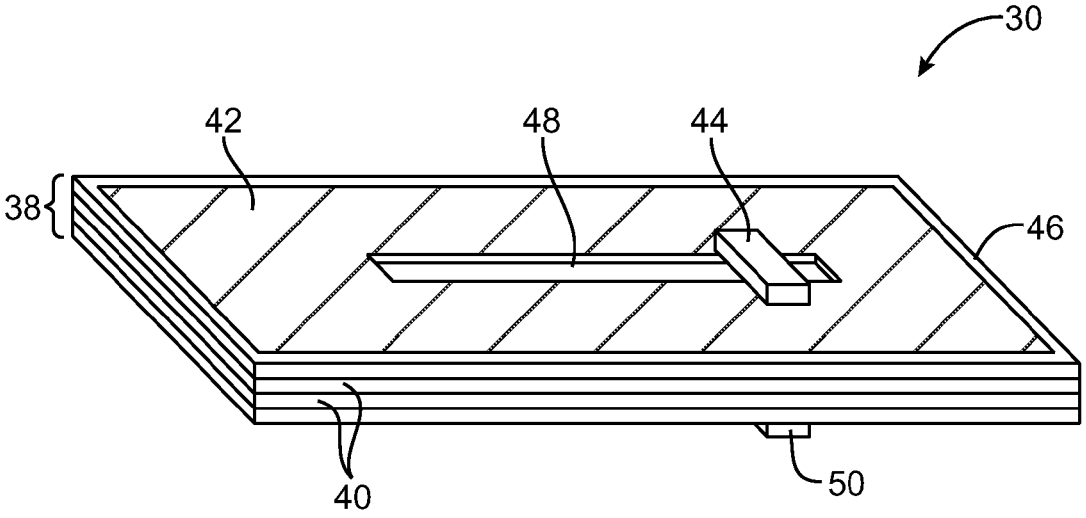
FIG. 5 is a perspective view of a flexible printed circuit substrate on which an antenna resonating element such as a slot antenna resonating element for an electrical device antenna may be formed in accordance with an embodiment of the present invention.

FIG. 5 is a perspective view of an illustrative antenna resonating element. As shown in FIG. 5, antenna resonating element 30 may be formed from a substrate such as a rigid or flexible printed circuit board substrate (substrate 38). Substrate 38 may contain layers of dielectric and patterned metal (shown schematically as layers 40 in FIG. 5). Components such as component 50 may be formed on the underside of substrate 38 (in the orientation of FIG. 5) and components such as component 44 may be formed on the top side substrate 38 (in the orientation of FIG. 5). Configurations in which components are mounted on only a single side of substrate 38 may also be used.

Components 44 and 50 may include electrical components such as surface mount technology (SMT) capacitors, resistors, inductors, switches, filters, radio-frequency connectors (e.g., miniature coaxial cable connectors), cables, clips, or other suitable components. Conductive traces in element 30 (e.g., patterned or blanket metal films on the surfaces of substrate 38 or in layers 40 of substrate 38) may be used to interconnect electrical components and to form antenna resonating element structures. Surface traces may be formed on upper surface 42 of antenna resonating element 30 (i.e., the interior surface of antenna resonating element 30 in the orientation of FIG. 4) or may be formed on the lower surface of antenna resonating element 30 (i.e., the exterior surface of antenna resonating element 30 in the orientation of FIG. 4).

One or more slots for antenna resonating element 30 such as antenna slot 48 may be formed within the layer of metal or other conductive material on surface 42 (or in layers 40). In the example of FIG. 5, slot 48 is formed in within metal layer 42 (e.g., a copper layer). Component 44 may be, for example, an SMT capacitor that bridges slot 48.

During assembly, a ring of conductive material such as a ring of solder formed on a ring of gold or other ring of material at the periphery of surface 42 that accepts solder (i.e., ring 46) may be used to electrically short and thereby seal the edges of antenna resonating element 30 to edges 34 and 36 of antenna cavity 26 (FIG. 4). Solder ring 46, which is sometimes referred to as a sealing ring or conductive sealing ring, may surround the periphery of layer 38 and may have a rectangular shape, a shape with curved edges, a shape with angled edges, a shape with combinations of straight and curved edges, etc.

Figure 6:
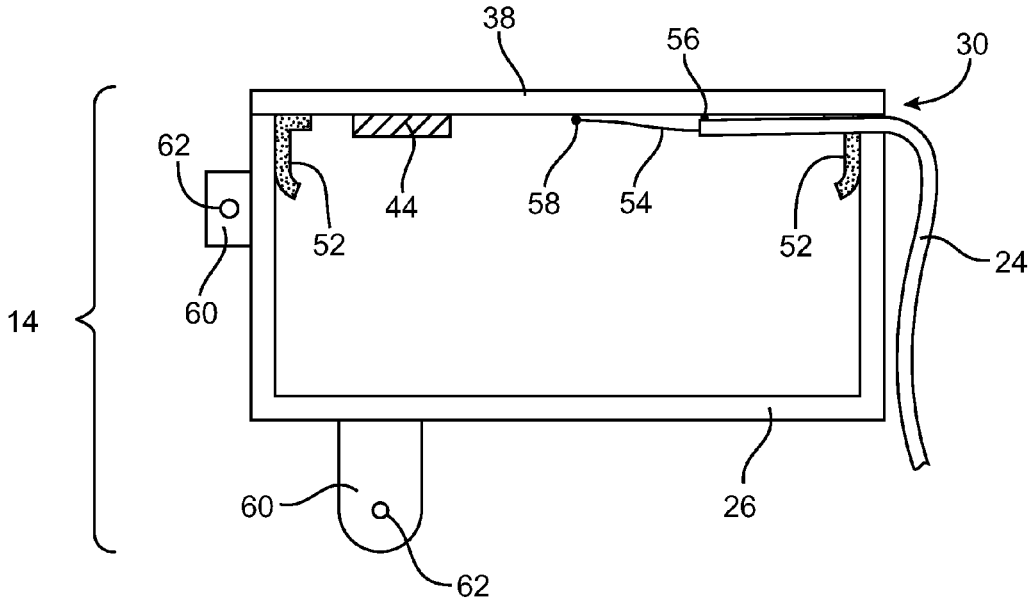
FIG. 6 is a cross-sectional view of an illustrative cavity antenna in accordance with an embodiment of the present invention.

A cross-sectional end view of cavity antenna 14 of FIG. 3 is shown in FIG. 6. As shown in FIG. 6, a transmission line such as coaxial cable 24 may be used to feed antenna 14. Transmitted radio-frequency antenna signals may be routed from transceiver circuitry 22 to antenna 14 using cable 24. During signal reception, received radio-frequency antenna signals may be routed from antenna 14 to transceiver circuitry 22 using cable 24. Cable 24 (or other transmission line structures in device 10) may be coupled to antenna 14 using antenna feed terminals such as positive antenna feed terminal 58 and ground antenna feed terminal 56. Ground feed 56 may be electrically connected to a conductive outer braid in cable (e.g., a ground path in cable 24) using solder or a connector. Positive feed 58 may be connected to positive center wire 54 (e.g., a positive signal path in cable 24) using solder or a connector. Antenna feed terminals 56 and 58 may bridge one or more slots such a slot 48 of FIG. 5.

Alignment brackets (spring clips) such as brackets 52 or other suitable alignment structures (e.g., plastic alignment structures) may be mounted to substrate 38 in antenna resonating element 30 (e.g., using solder, fasteners such as screws, clips, springs, welds, adhesive, etc.). Alignment structures such as brackets 52 may help to align resonating element 38 with respect to cavity 26 during assembly. If desired, mounting structures such as mounting brackets 60 may be connected to cavity structure 26 (e.g., using welds or other suitable attachment mechanisms). Brackets 60 may be provided with openings such as holes 62. Screws, heat stakes, alignment posts, or other structures may pass through holes 62 when antenna 14 is mounted within housing 12 of device 10.

Figure 7:
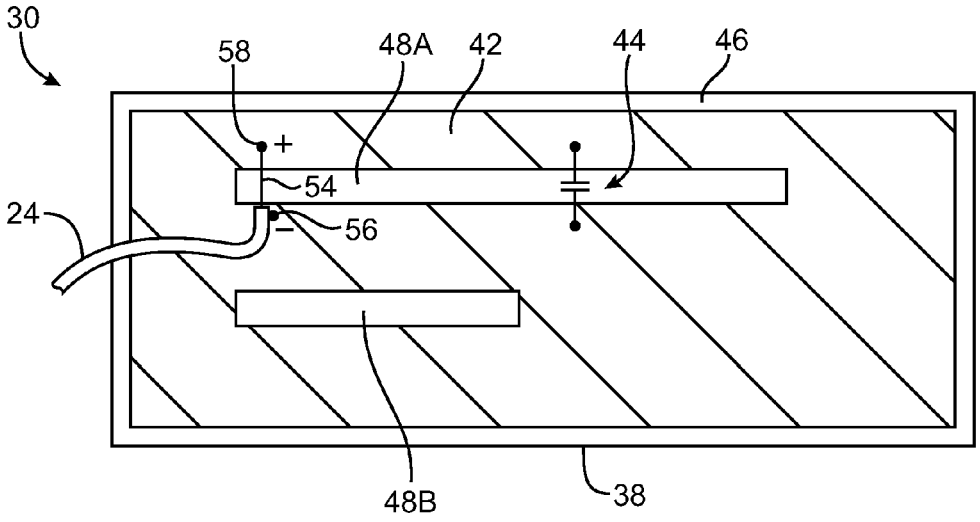
FIG. 7 is a plan view of an illustrative rectangular flexible printed circuit on which a slot antenna resonating element with a directly fed slot and a near-field-coupled parasitic slot have been formed for use in a cavity-backed electronic device antenna in accordance with embodiments of the present invention.

If desired, more than one slot may be included in antenna resonating element 30. FIG. 7 shows an illustrative configuration that may be used for antenna resonating element 30 that is based on two slots. Each slot in antenna resonating element 30 of FIG. 7 may be formed from a respective opening in conductive layer 42 (e.g., a copper layer that extends across the entire surface of the substrate for antenna resonating element). Conductive solder ring 46 may surround the periphery of layer 42. Ring 46 may be formed before or after element 30 is mounted to cavity 26. Components such as component 44 (e.g., an SMT capacitor) may be mounted to element 30 (e.g., with a pair of terminals that bridge one or more of slots 48).

One or both of the slots may be fed using the antenna feed formed from feed terminals 56 and 58. In the example of FIG. 7, upper slot 48A is directly fed using feed terminals 56 and 58 that are located on opposing sides (i.e., the longer sides) of slot 48A and this slot is bridged by capacitor 44, whereas lower slot 48B serves as a parasitic antenna element that is not directly feed by transmission line 24. In this type of configuration, the lower slot is near-field coupled to the upper slot through near-field electromagnetic coupling. Parasitic slot 48B, in conjunction with tuning elements such a capacitor 44, tunes antenna 14. This allows attributes of the performance of antenna 14 such as the bandwidth of antenna 14 and the location of resonant peaks in the performance of antenna 14 to be optimized.

Figure 8:
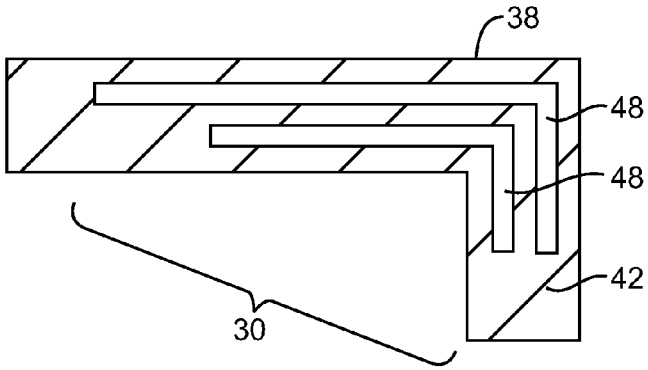
FIG. 8 is a plan view of an illustrative flexible printed circuit structure having a footprint with an angled section on which a slot antenna resonating element with a directly fed slot and a near-field-coupled parasitic slot have been formed for use in a cavity-backed electronic device antenna in accordance with embodiments of the present invention.

FIG. 8 shows how slots 48 may have other shapes (e.g., rectangles with bends). In general, there may be any number of directly fed slots and parasitic slots and these slots may be rectangular, rectangular with multiple arms or bends, curved shapes, etc. In a typical dual band arrangement, the size of the directly fed slot has a perimeter equal to one wavelength at the fundamental frequency of interest (i.e., at the center frequency of the lower band). Response in the upper band can be obtained by exploiting harmonic resonances (i.e., the center frequency of the upper band may coincide with a harmonic of the fundamental frequency).

Figure 9:
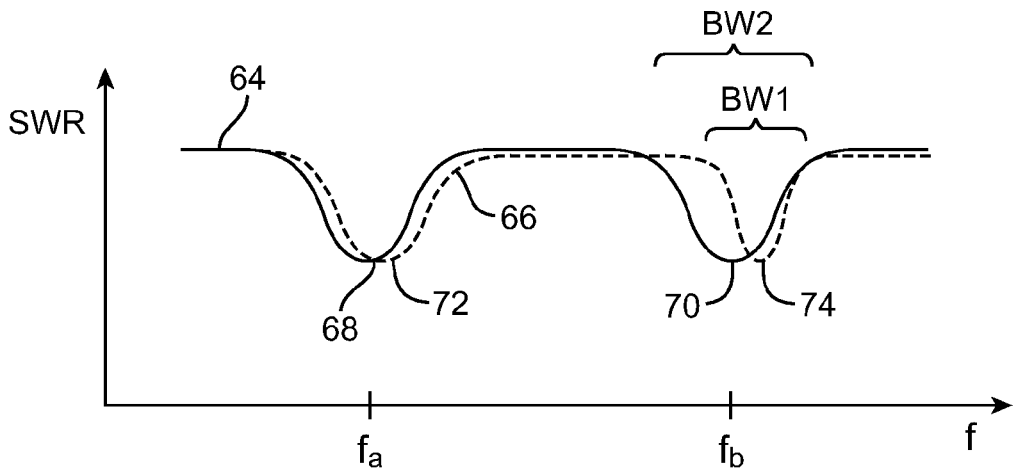
FIG. 9 is a graph showing how a cavity-backed slot antenna design may be used to implement a dual-band antenna in accordance with an embodiment of the present invention.

The impact of tuning on the performance of a cavity-backed slot antenna with an antenna resonating element of the type shown in FIG. 7 is shown in FIG. 9. FIG. 9 is a graph of antenna performance (standing wave ratio SWR) versus operating frequency f. Dashed curve 66 corresponds to antenna performance when antenna slot 48A is fed in the absence of parasitic slot 48B and in the absence of tuning capacitor 44. Solid curve 64 corresponds to antenna performance when antenna slot 48A is fed directly, parasitic slot 48B is present, and tuning capacitor 44 is present.

In the example of FIG. 9, frequencies fa and fb are center frequencies for a dual band antenna such as a dual band antenna for supporting IEEE 802.11 communications. In this type of scenario, frequency fa may be, for example, 2.4 GHz and frequency fb may be, for example, 5 GHz. Other types of antenna arrangements (e.g., using fewer than two bands or more than two bands in antenna 14 or using different band frequencies) may also be used. The use of a dual band IEEE 802.11 configuration is merely illustrative.

When slot 48B and capacitor 44 are not present, the antenna may exhibit resonant peaks 72 and 74 that are not both aligned with desired communications bands (i.e., peaks 72 and 74 may not both be aligned with band center frequencies fa and fb). The bandwidths of the antenna in the upper and lower bands may also be narrower than desired. For example, the bandwidth BW1 of the band associated with resonant peak 74 (i.e., the upper band) may be undesirably narrow.

When slot 48B and capacitor 44 are present, antenna 44 may operate as desired. In particular, resonant peak 74 may be moved lower in frequency by the presence of capacitor 44 (larger values of which may be used to produce correspondingly larger downward frequency shifts in peak 74). In this position, frequency peak 70 may be properly aligned with upper band center frequency fb. The position of peak 72 may also shift (e.g., to the position shown by frequency peak 68, which is properly aligned with lower band frequency fa). The presence of parasitic slot 48B may help broaden the bandwidth of the antenna. For example, the bandwidth of antenna 14 at upper frequency fb may be broadened from BW1 (when no parasitic slot is present) to BW2 (in the presence of parasitic slot 48B).

The foregoing is merely illustrative of the principles of this invention and various modifications can be made by those skilled in the art without departing from the scope and spirit of the invention.

What is claimed is:

1. A cavity-backed slot antenna, comprising:

a conductive cavity; and an antenna resonating element comprising a first slot that is directly fed using first and second antenna feed terminals and a second slot that is not directly feed by the first and second antenna feed terminals and that serves as a parasitic antenna slot, wherein the conductive cavity has cavity edges, wherein the antenna resonating element comprises a layer of metal in which the first and second slots are formed, wherein the layer of metal has peripheral edges, and wherein the cavity-backed slot antenna further comprises a conductive ring of solder along the peripheral edges that electrically connects the peripheral edges of the layer of metal in the antenna resonating element to the cavity edges.

2. The cavity-backed slot antenna defined in claim 1 further comprising an electrical component on the antenna resonating element that tunes the antenna.

3. The cavity-backed slot antenna defined in claim 1 further comprising a capacitor on the antenna resonating element that is electrically connected across the first slot.

4. The cavity-backed slot antenna defined in claim 1 wherein the antenna resonating element comprises a flexible printed circuit board substrate.

5. The cavity-backed slot antenna defined in claim 4 wherein the flexible printed circuit board substrate comprises epoxy.

6. The cavity-backed slot antenna defined in claim 4 wherein the flexible printed circuit board substrate comprises fiberglass-filled epoxy having a thickness of less than 0.2 mm.

7. The cavity-backed slot antenna defined in claim 1 wherein the ring of solder shorts the antenna resonating element to the conductive cavity.

8. The cavity-backed slot antenna defined in claim 1 wherein the cavity edges include at least one curved cavity edge, wherein the layer of metal comprises a non-planar layer of metal in which the first and second slots are formed, and wherein the conductive ring of solder electrically connects the peripheral edges of the non-planar layer of metal in the antenna resonating element to the cavity edges including the curved cavity edge.

9. The cavity-backed slot antenna defined in claim 1 wherein the conductive cavity has a curved non-planar opening and wherein the layer of metal is flexed about a flex axis to mate with the curved non-planar opening of the conductive cavity.

10. A cavity antenna, comprising:

a conductive cavity having a curved non-planar opening;

an antenna resonating element having a non-planar layer of metal that forms a curved shape that mates with the curved non-planar opening, wherein the antenna resonating element comprises first and second antenna slots in the non-planar layer of metal; and a first antenna feed terminal and a second antenna feed terminal, wherein the first antenna feed terminal and the second antenna feed terminal are located on opposing sides of the first antenna slot.

11. The cavity antenna defined in claim 10 further comprising a capacitor that is connected across one of the two antenna slots.

12. The cavity antenna defined in claim 10 wherein the antenna resonating element comprises a flexible printed circuit board substrate and wherein the conductive cavity is filled with air.

13. The cavity antenna defined in claim 12 wherein the first antenna slot comprises a directly fed antenna slot and wherein the second antenna slot comprises a parasitic antenna slot.

14. The cavity antenna defined in claim 10 wherein the non-planar metal layer has peripheral edges, wherein the conductive cavity comprises cavity edges, and wherein the antenna resonating element is sealed to the cavity with a ring of solder that shorts the peripheral edges of the antenna resonating element to the cavity edges.

15. An electronic device, comprising:

a curved electronic device housing wall; and a cavity antenna having a conductive antenna cavity with a curved cavity opening and having a non-planar antenna resonating element that is flexed to mate with the curved cavity opening, wherein the non-planar antenna resonating element lies flush with the curved electronic device housing wall.

16. The electronic device defined in claim 15 wherein the antenna resonating element comprises a flexed printed circuit board having a non-planar layer of metal in which a directly fed antenna slot is formed and in which a parasitic antenna slot is formed and wherein the cavity antenna is filled with air.

17. The electronic device defined in claim 16 further comprising a ring of solder that electrically connects the non-planar layer of metal to mating edges of the conductive antenna cavity.

18. The electronic device defined in claim 15 further comprising:

processing circuitry, wherein the curved electronic device housing wall comprises exterior surface portions of the electronic device.

* * * * *